United States Patent [19]

Swift et al.

[11] 3,969,970

[45] July 20, 1976

[54] TRANSPARENT GRAND PIANO TOPS

[75] Inventors: Howard R. Swift; Kenneth C. Livingston, both of Toledo, Ohio

[73] Assignee: Libbey-Owens-Ford Company, Toledo, Ohio

[22] Filed: Nov. 8, 1974

[21] Appl. No.: 522,239

[52] U.S. Cl. ..... 84/177; 84/452 R

[51] Int. Cl.[2] ..... G10C 3/02

[58] Field of Search ..... 84/174, 177, 452; 16/128 R

[56] References Cited

UNITED STATES PATENTS

| | | | |
|---|---|---|---|
| 1,459,378 | 6/1923 | Schenuit | 84/177 |
| 2,024,829 | 12/1935 | Loitsch | 84/177 |
| 2,244,042 | 6/1941 | Barlow | 16/128 R |
| 2,530,251 | 11/1950 | Luberoff | 84/177 |
| 2,626,433 | 1/1953 | Murch | 16/128 R |

OTHER PUBLICATIONS

"Music Tredes", 10/73, Article on Transparent Steinway Piano Top, Hale Catalog No. 43, 1953, p. 79.

*Primary Examiner*—L. T. Hix
*Assistant Examiner*—Vit W. Miska
*Attorney, Agent, or Firm*—Collins, Oberlin & Darr

[57] ABSTRACT

This application discloses a grand piano with a transparent lid or cover, and a special hinge structure mounting the lid for pivotal movement into open and closed positions.

6 Claims, 4 Drawing Figures

TRANSPARENT GRAND PIANO TOPS

BACKGROUND

1. Field of the Invention

The present invention relates broadly to cabinet type musical instruments and closures therefor. More particularly it has to do with cases for grand pianos that are provided with transparent tops and means permitting opening and closing thereof.

2. Description of the Prior Art

Grand pianos are of course old and well known, as is the fact that it has been considered desirable to open their quite large and cumbersome, opaque, wooden tops; and to prop them open, while the piano is being played. This is especially true when an artiste is performing in concert or on the stage and, in that environment, has been found to present some problems of visibility that can become quite serious. For example, even when an individual pianist is playing on stage there may be some of the audience who are unable to see him to best advantage because a part or all of their view is blocked by the raised piano lid or top. A more serious problem is encountered when the pianist performs on the type of concert platform that is largely or completely surrounded by the audience. Similarly, when the pianist is part of, or is being accompanied by, a large orchestra, views of other parts of the orchestra or even of the conductor may be cut off; as may be that of singing artists, or instrumental solists which the pianist may be accompanying.

SUMMARY OF THE INVENTION

According to the present invention, however, there is provided a transparent top or lid, with a structure for mounting it on a grand piano, that eliminates any possibility of visual obstruction when the lid is raised and propped up in open position.

It is therefore a primary object of the invention to provide grand pianos with tops that can be held in open position and still permit as free and uninterrupted vision over the piano as when it is closed.

Another object is the provision of improved means mounting the transparent cover for movement into open and closed positions.

Another object is to provide a special hinge type structure for such mounting means.

Still another object is to provide a hinge assembly for this purpose that can be effectively employed without the necessity of cutting into or drilling through the transparent cover.

Further objects and advantages will become apparent during the course of the following description, when taken in connection with the accompanying drawings.

BRIEF DESCRIPTION OF THE DRAWINGS

In the drawings, wherein like numerals are employed to designate like parts throughout.

DESCRIPTION OF THE PREFERRED EMBODIMENTS

Figure 1:
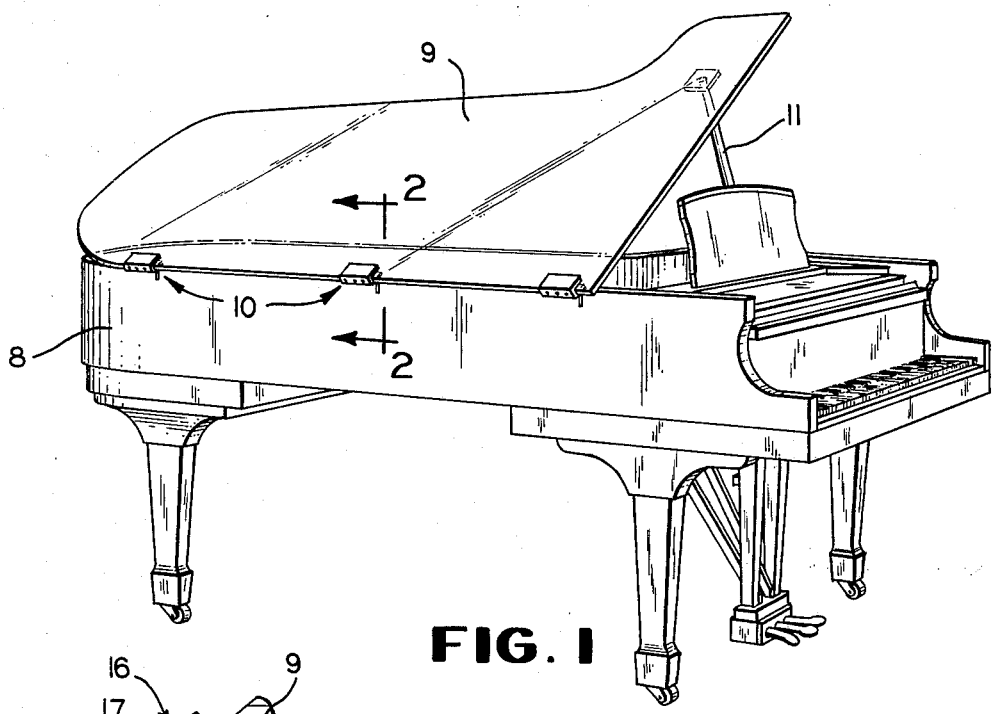
FIG. 1 is a perspective view of a grand piano, provided with the hinged, transparent top or lid of the invention.

Referring now more particularly to the drawings, there is illustrated in FIG. 1 a conventional form of grand piano having a case 8, that is provided with a transparent top 9, swingably mounted for movement into open and closed positions by hinges 10. As shown, the lid or top 9 has been lifted into raised position, and is being maintained there by means of a conventional type of hinged prop 11.

Figure 2:
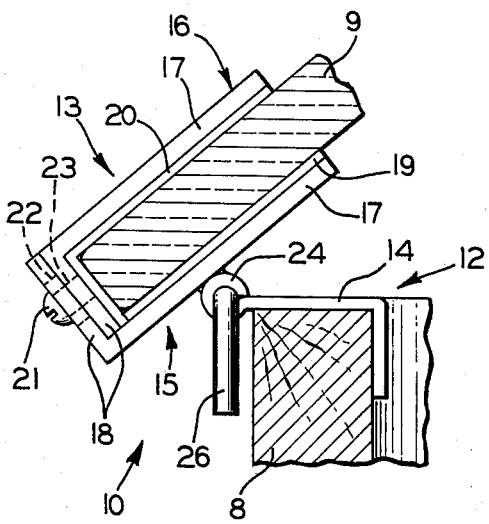
FIG. 2 is a fragmentary, vertical, sectional view taken substantially along the line 2—2 in FIG. 1.

As indicated in FIG. 2, the transparent top 9 may be a relatively heavy sheet of tempered glass, i.e., glass that has been specially strengthened by first heating it to substantially its softening point and then rapidly chilling it, as by blasts or jets of air directed against its opposite surfaces, to place interior of the sheet in tension and its outer surfaces in compression. Alternatively, the top 9 may be of other transparent materials including, glass, plastics and the like in a variety of forms and combinations. For example, laminated safety glass, which is made up of two sheets of glass with an interposed layer of non brittle plastic all sandwiched together into a composite unit under heat and pressure, is currently in successful use by the Boston Pops orchestra under the direction of Arthur Fiedler.

Because of the frangible nature of the outer surfaces of even strengthened glass structures, it is desirable that the mounting means for the transparent piano tops of the invention be such that they will not injure, or require perforation of the top, during either installation or use. To this end the invention contemplates a hinge structure 10 of a type that embraces or clamps around the lower margin of the top 9, rather than being secured to it by screws or other mechanical fastening means.

Thus, one half 12 of the hinges 10 may be of conventional, or of relatively simple, form. Comprising, for example as shown in FIG. 2, an angle plate having a horizontal side 14 that is inset in the top edge and a vertical side that is secured to the inside wall of the case 8. However, the other, or top-embracing, half 13 of the hinges are made up of two cooperating parts 15 and 16 that are generally L shaped in vertical cross section and that are adapted to interfit with one another to embrace the margin of the piano top when one is reversed and both are positioned so that the opposed inside surfaces of their legs 17 lie along opposite surfaces of the top 9, as shown in FIG. 2, and the bottoms 18 of the L's slide one over the other and face and overlap the bottom edge of the transparent top.

When the parts 15 and 16 of the hinge half 13 are of metal or other hard substance, it is desirable to provide pads 19 and 20 of a soft material such as felt or rubber between the hinge part and the glass of the piano top. In any event, however, the L shaped parts 15 and 16 of the hinges are held together, and in embracing and/or clamping relationship with the transparent top 9 by means of machine screws, bolts or the like 21 that are adapted to pass through openings 22 in the bottom 18 of one member 15 and be threaded into openings 23 in the bottom 18 of the other member 16. The openings 22 are preferably elongated or of slot-like formation to permit adjustment of the legs 17 of the parts 15 and 16 toward and away from one another after the bolts 21 have been threaded into the openings 23 but before they have been tightened to maintain the parts 15 and 16 in fixed position relative to one another and to the top 9.

Figure 3:
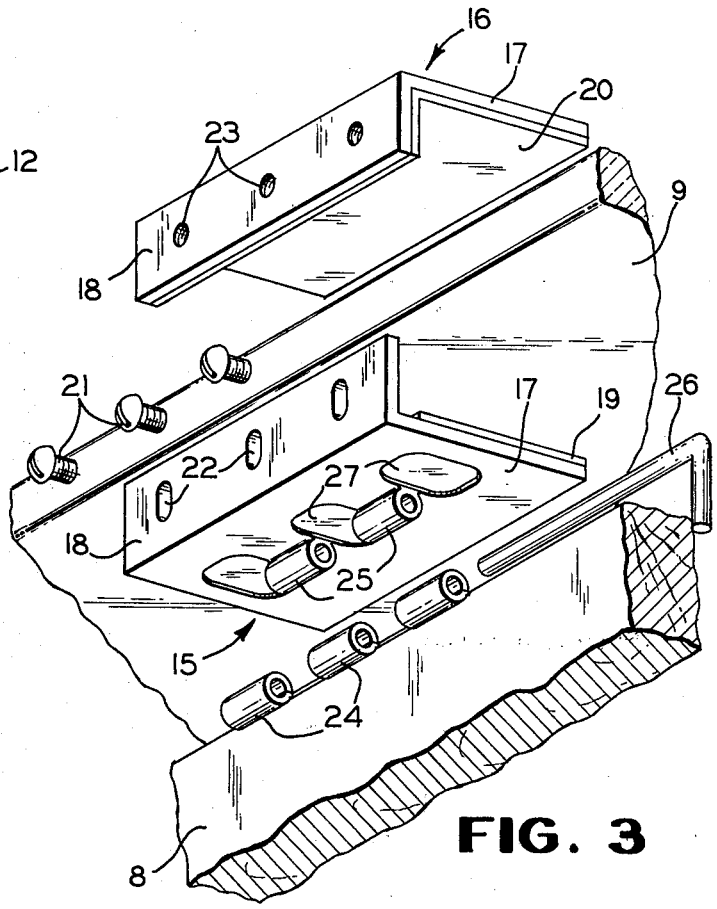
FIG. 3 is an exploded, perspective view, looking upwardly at the structure shown in FIG. 2.

As best shown in FIGS. 2 and 3, pivotal movement between the hinge halves 12 and 13 is provided by cooperating cylindrical members 24 and 25 formed on or otherwise associated with the outer end of the horizontal side 14 of the angle plate of the hinge half 12, and with the outside surface of the leg 17 of one of the L-shaped parts of the hinge half 13 respectively. With the hinge halves positioned so that their respective cylindrical members 24 and 25 are in aligned and interfitting relationship a pintle, such as the L shaped pin 26, can be inserted therethrough to provide the pivot point for the hinged structure; and indented or undercut areas 27 are provided when and wherever necessary for adequate clearance.

As also shown in FIG. 2 the legs 17 and bottoms 18 of the parts 15 and 16 of the hinge halves 13 may be at substantially right angles to one another. However, under most conditions, and dependent also to some extent on the materials from which the hinges are made and their physical characteristics, it may be desirable to have the angle between the legs 17 and the bottoms 18 of one or the other or both of the parts of the hinge halves at angles of less than 90° to one another.

Figure 4:
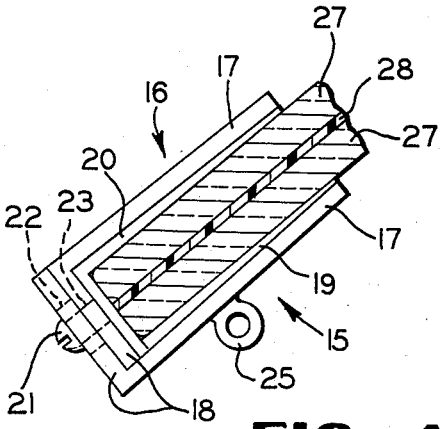
FIG. 4 is a view similar to FIG. 2, but of only one half of the hinge structure, and showing a slightly modified form of lid embracing means.

Thus, as indicated in FIG. 4, when this is done the legs 17 can be made to exert a progressively greater gripping force on the glass of the top as they extend upwardly from their bottoms 18. When the legs 17 are of rigid construction the effect of the increasing force is primarily to compress and compact the cushioning material 19 and 20 as shown. However, with the legs 17 of resilient construction a somewhat different, but at least equally and perhaps even more satisfactory effect may be attained.

In either event, however, it has been determined that an angle of approximately 89° between the leg and bottom of each L-shaped part is preferable, but that any variation that results in the sum of the angles of both falling between 170° and 180° will insure satisfactory results.

Also, it will be noted that the glass top shown in FIG. 4 is of the laminated safety glass type referred to above and comprises two sheets of glass 27 with an interposed layer 28 of plastic. However, it is to be understood that the forms of the invention herewith shown and described are to be taken as the preferred embodiments only of the same, and that various changes in the shape, size and arrangement of parts may be resorted to without departing from the spirit of the invention as defined in the subjoined claims:

We claim:

1. The combination, with a case for a grand piano that includes means for holding a cover therefor raised and in an open position; of a transparent cover shaped to fit said case, and hinge means embracing a margin of said transparent cover and mounted on said case to permit pivotal movement of said cover into open and closed positions; and in which a part of said hinge means comprises a pair of L shaped members positioned with the legs thereof on opposite sides of said margin of said transparent cover and the bottoms thereof overlapping an edge of said cover and in sliding relation to each other, means for retaining said members in embracing relationship to said margin, and means mounting one of said members on said case for pivotal movement relative thereto.

2. A combination as defined in claim 1, in which said retaining means is of a screw type passing freely through an opening in one of said bottoms and threaded into the other.

3. A combination as defined in claim 1, in which protective cushioning means is inserted between said members and said transparent cover.

4. A combination as defined in claim 1, in which the leg of at least one of said L shaped members is at an angle of less than 90° with the bottom thereof.

5. A combination as defined in claim 4, in which said angle is at least 80°.

6. A combination as defined in claim 4, in which said angle is approximately 89°.

* * * * *